United States Patent [19]

Lense

[11] Patent Number: 4,887,392

[45] Date of Patent: Dec. 19, 1989

[54] APPARATUS FOR ACTUATING AND LOCKING A WINDOW SASH

[75] Inventor: Robert F. Lense, Rockford, Ill.

[73] Assignee: Amerock Corporation, Rockford, Ill.

[21] Appl. No.: 338,441

[22] Filed: Apr. 13, 1989

Related U.S. Application Data

[63] Continuation of Ser. No. 219,582, Jul. 14, 1988, abandoned, which is a continuation-in-part of Ser. No. 139,977, Dec. 31, 1987, abandoned.

[51] Int. Cl.[4] ..... E05F 11/00

[52] U.S. Cl. ..... 49/300; 49/342

[58] Field of Search ..... 49/246, 249, 250, 281, 49/300, 341, 342

[56] References Cited

U.S. PATENT DOCUMENTS

| | | | |
|---|---|---|---|
| 1,724,011 | 8/1929 | Flagg | 49/341 |
| 2,366,613 | 1/1945 | Hagstrom . | |
| 2,817,511 | 12/1957 | Reynard | 49/341 |
| 3,032,330 | 5/1962 | Stavenar | 49/342 |
| 4,497,135 | 2/1985 | Vetter . | |
| 4,553,656 | 12/1985 | Lense | 49/280 |
| 4,703,960 | 11/1987 | Lense | 49/280 |

FOREIGN PATENT DOCUMENTS

| | | |
|---|---|---|
| 226785 | 7/1987 | European Pat. Off. . |
| 692652 | 11/1930 | France . |

*Primary Examiner*—Kenneth J. Dorner
*Assistant Examiner*—Gerald A. Anderson
*Attorney, Agent, or Firm*—Leydig, Voit & Mayer Ltd.

[57] ABSTRACT

Apparatus for causing a rotatable actuator to effect unlocking of a window latch and then to swing the window sash open when the actuator is rotated in one direction. When the actuator is rotated in the opposite direction, it first causes the sash to swing closed and then causes the latch to lock and hold the sash in its closed position. In one embodiment, the actuator is effective to swing an arm and shift a slide for purposes of moving the sash and operating the latch. In another embodiment, the actuator rotates a lead screw which advances nuts for moving the sash and operating the latch.

20 Claims, 9 Drawing Sheets

APPARATUS FOR ACTUATING AND LOCKING A WINDOW SASH

CROSS-REFERENCE TO A RELATED APPLICATION

This application is a continuation of copending application Ser. No. 219,582 filed July 14, 1988, now abandoned, which, in turn is a continuation-in-part of application Ser. No. 139,977, filed on Dec. 3, 1987, and now abandoned.

BACKGROUND OF THE INVENTION

This invention relates generally to apparatus for use with windows and specifically for use with windows such as a casement window having a sash which is adapted to be swung about an upright axis between closed and open positions.

Modern casement windows usually are associated with a reversible rotary actuator which may be used to open and close the window sash. The actuator may be in the form of a hand crank adapted to be turned in one direction to open the sash and in the opposite direction to close the sash. Alternatively, the actuator may be a reversible electric motor which is associated with the sash in the manner disclosed in Lense U.S. Pat. No. 4,553,656.

A casement window usually is equipped with one or more latches for locking the sash in its closed position. While the latch may be power-operated as disclosed in Lense U.S. Pat. No. 4,703,960, the latch more conventionally is operated manually. If the latch is locked, it must be unlocked before the sash can be opened and then must be re-locked to secure the sash after the latter has been closed. In prior windows with manually operable latches, two separate operations are necessary in order to unlock and open the sash and then two more separate operations are required to close and lock the sash. In some cases, the sash may be fully closed but inadvertently left in an unlocked condition.

Vetter et al U.S. Pat. No. 4,497,135 discloses mechanism for automatically unlocking and opening a sash and for automatically closing and locking the sash. That mechanism, however, is relatively complex and requires a motor, planetary gearing driven by the motor and a trigger for sensing the position of the sash.

SUMMARY OF THE INVENTION

The general aim of the present invention is to provide new and improved window apparatus in which the sash actuator is uniquely linked to the sash and to the sash latch by relatively simple mechanism capable of effecting automatic unlocking of the latch when the sash actuator is operated to open the sash and automatic locking of the sash when the actuator is operated to close the sash.

Another object of the invention is to use the sash actuator to effect automatic unlocking of the sash just prior to opening of the sash and to effect automatic locking of the sash at about the same time the sash reaches its fully closed position without need of relying on a sensor or the like for detecting the position of the sash.

A more detailed object is to achieve the foregoing by providing apparatus in which a single sash actuator operates extremely simple latch and sash linkages in a predetermined timed relationship resulting in unlocking of the sash just prior to opening of the sash and resulting in locking of the sash during or just after full closure of the sash.

Still another object is to provide a sash linkage which positively holds the sash against buffeting when the sash is in an open position.

The invention also resides in the novel construction of the latch to facilitate the opening of a stuck sash and to help draw the sash to a fully closed position.

These and other objects and advantages of the invention will become more apparent from the following detailed description when taken in conjunction with the accompanying drawings.

DETAILED DESCRIPTION OF THE PREFERRED EMBODIMENT

Figure 1:
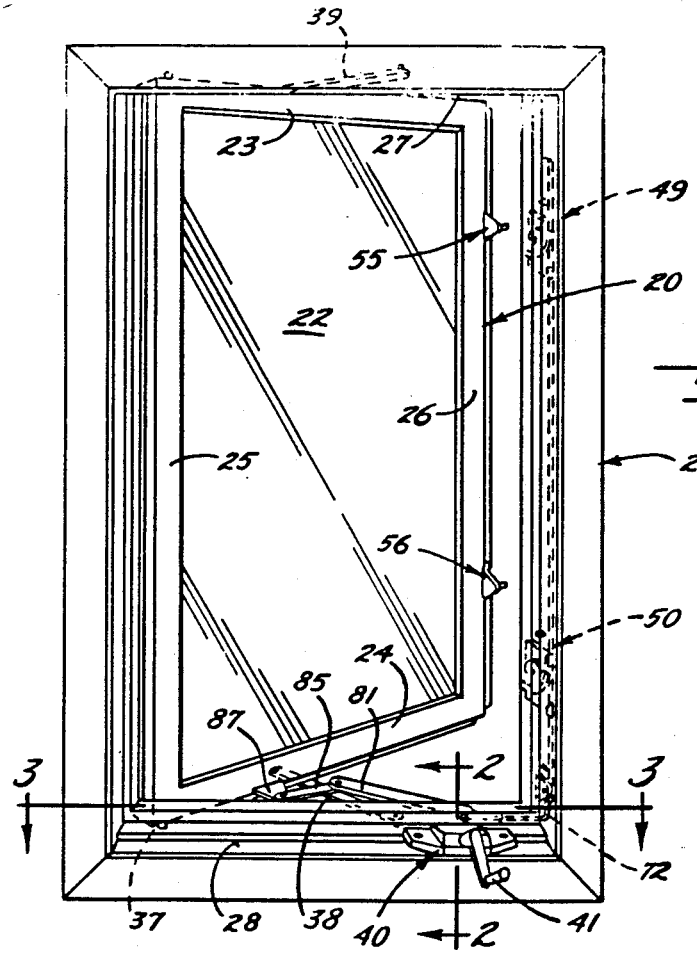
FIG. 1 is a perspective view of a window equipped with one embodiment of new and improved apparatus incorporating the unique features of the present invention and shows the sash in partially open position.

For purposes of illustration, the invention is shown in the drawings as being embodied in apparatus for causing a casement window sash 20 to swing between closed and open positions in a window frame 21 and for releasably locking the sash in its closed position. The sash itself is of conventional rectangular construction and includes a glass pane 22 which is supported by horizontal top and bottom members 23 and 24 and by left and right upright side members 25 and 26.

Figure 2:
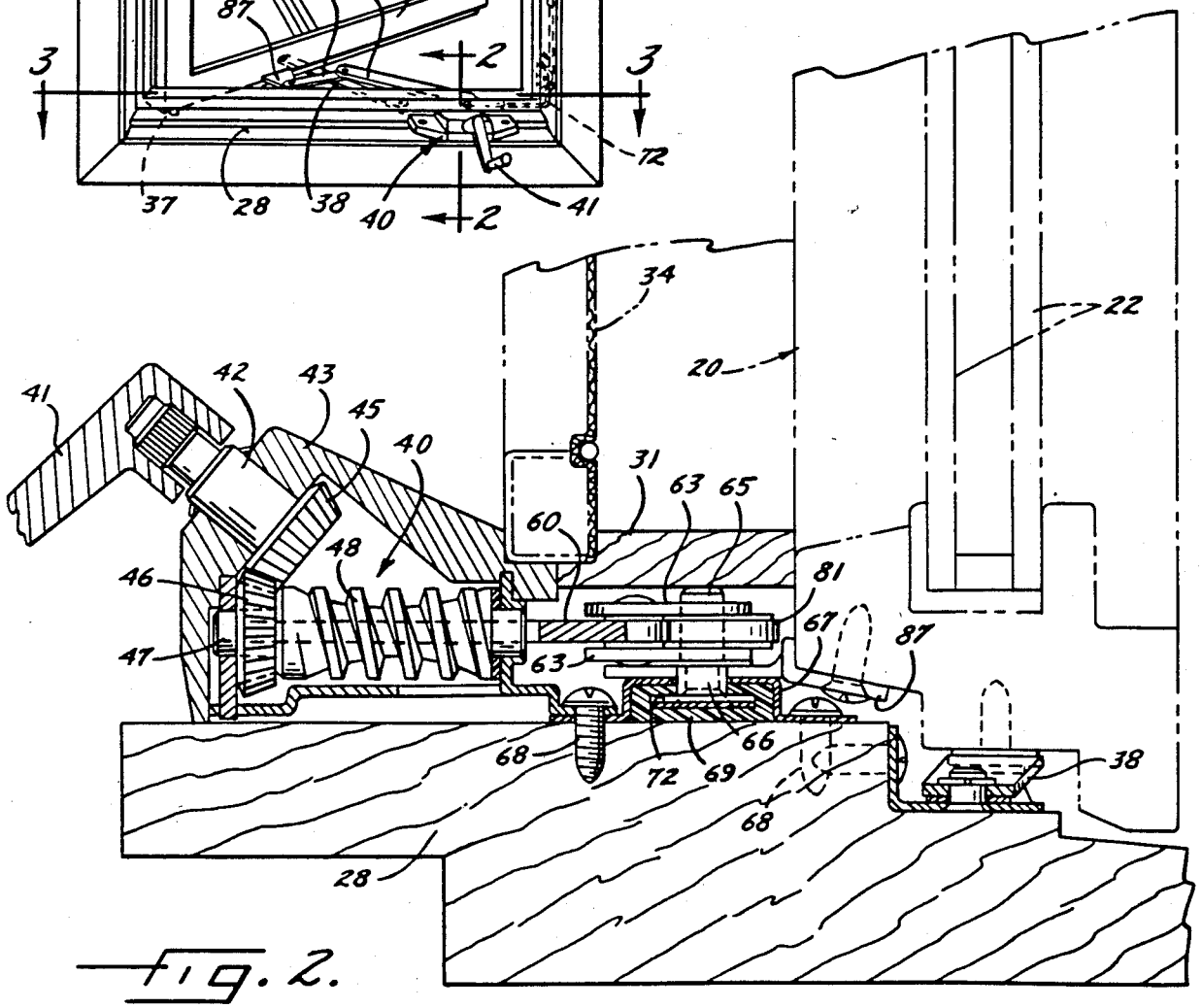
FIG. 2 is an enlarged fragmentary cross-section taken substantially along the line 2—2 of FIG. 1 but shows the sash in a closed and locked position.
Figures 3, 4, 5, 6:
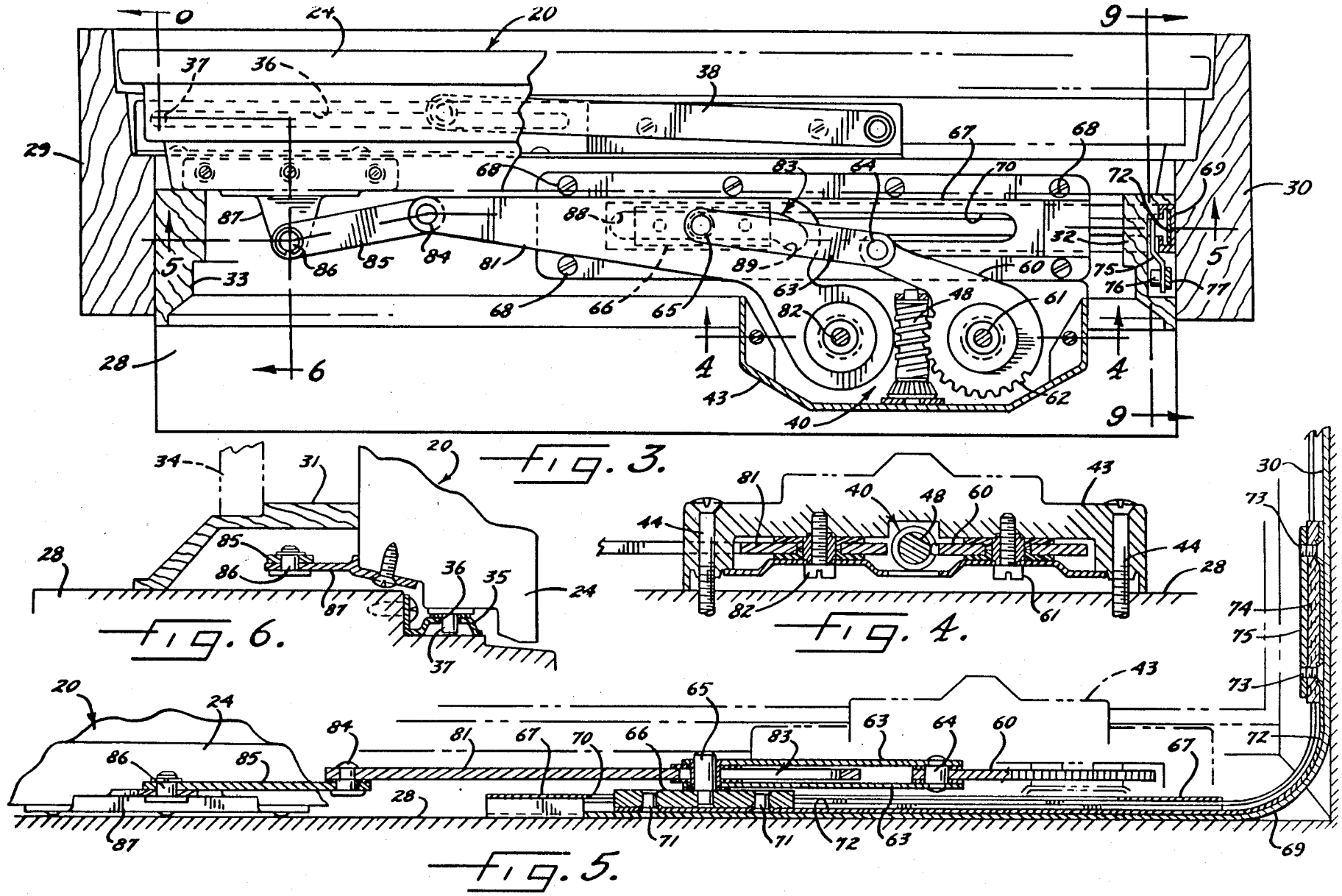
FIG. 3 is an enlarged cross-section taken substantially along the line 3—3 of FIG. 1 and also shows the sash in a closed and locked position.
FIGS. 4, 5 and 6 are enlarged fragmentary cross-sections taken substantially along the lines 4—4, 5—5 and 6—6, respectively of FIG. 3.

The frame 21 also is rectangular and is defined by a top header 27, a bottom sill 28 and by left and right side jambs 29 and 30 (FIG. 3). Generally channel-shaped moulding strips 31 (FIG. 6) and 32 (FIG. 3) extend alongside the sill 28 and the right side jamb 30, respectively, a moulding strip 33 (FIG. 3) extends alongside the left side jamb 29 and an additional moulding strip (not visible) is located alongside the header 27. A screen 34 (FIG. 2) is removably positioned in the opening defined by the frame 21.

To support the sash 20 for movement between its closed and open positions, a horizontal track 35 (FIG. 7) is attached to the sill 28 adjacent the left side jamb 29 and is formed with an elongated and laterally extending slot 36. The slot receives a pivot pin 37 which extends downwardly from the bottom member 24 of the sash. Similar structure (not fully visible) is located at the upper left portion of the sash. During opening of the sash, the pin 37 moves from left-to-right in the slot 36 and, at the same time, the sash swings counterclockwise (FIG. 7) about the axis of the pin. The sash swings clockwise about the axis of the pin 37 as the sash is closed and as the pin moves from right-to-left in the slot 36. Movement of the sash is controlled in part by a swivel arm 38 having an outer end pivotally connected to the bottom member 24 of the sash and having an inner end pivotally connected to the sill 28. A similar swivel arm 39 (FIG. 1) is located at the top of the sash.

Opening and closing of the sash 20 is effected by a reversible rotary actuator 40 which, in this particular instance, includes a conventional hand crank 41. The crank is connected rigidly to the inner end portion of a spindle 42 (FIG. 2) which is rotatably journaled in an actuator cover 43 fastened to the sill 28 by screws 44 (FIG. 4). A bevel gear 45 (FIG. 2) on the outer end of the spindle meshes with a bevel gear 46 on a shaft 47 which is rotatably supported within the cover and which carries a worm 48. The sash 20 is opened and closed when the crank 41 is turned clockwise (FIG. 1) and counterclockwise, respectively.

Figure 11:
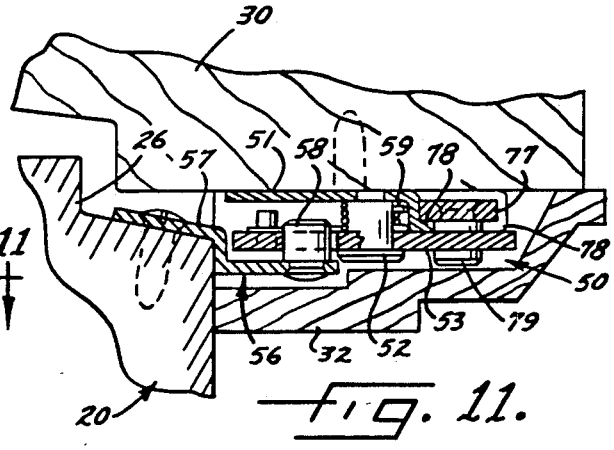
Figure 15:
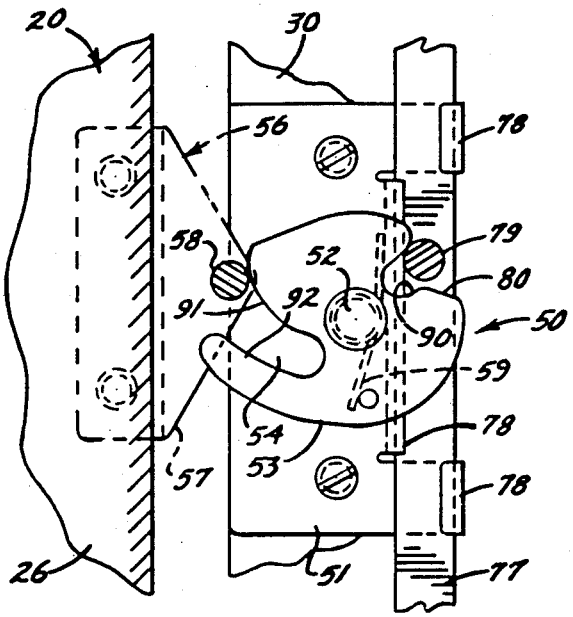

When the sash 20 is in its closed position, it is adapted to be locked releasably and, in this instance, the locking is effected by upper and lower latches 49 and 50 (FIGS. 1 and 9) although, in many cases, a single latch could be used to lock the sash. Each latch includes a base plate 51 (FIG. 9) fastened to the right side jamb 30 and located between the jamb and the channel-shaped moulding 32. Rotatably supported on a horizontal pin 52 on each base plate is a latching bolt 53 formed with a U-shaped notch or throat 54. The latch bolts of the upper and lower latches 49 and 50 are adaptd to coact with upper and lower strikes 55 and 56 (FIGS. 1 and 9), respectively, supported on the inner side of the right frame member 26 of the sash 20. Each strike includes a generally triangular mounting plate 57 (FIGS. 9 and 11) attached to the frame member 26 and supporting a horizontal pin 58 which projects toward the right side jamb 30. When the latch bolts 53 are in locked positions shown in FIG. 9, the strike pins 58 are captivated within the throats 54 of the latch bolts so as to prevent opening of the sash 20. When each latch bolt is rotated counterclockwise to an unlocked position shown in FIG. 15, the throat 54 releases the strike pin and frees the sash to open. A torsion spring 59 encircles the mounting pin 52 of each latch bolt and urges the latch bolt toward its unlocked position.

In accordance with the present invention, operation of the rotary actuator 40 in one direction automatically effects movement of the latching bolts 53 to their unlocked positions and then effects opening of the sash 20. When the rotary actuator is operated in the opposite direction, the sash is closed and, at about the same time the sash reaches its fully closed position, the actuator effects automatic movement of the latch bolts to their locked positions. In this way, only one operation is required to unlock and open the sash and only one operation is required to close and lock the sash.

More specifically, the rotary actuator 40 includes an actuating or driver arm 60 which is supported to turn back and forth about a vertical pivot defined by a screw 61 in the cover 43. The inner end portion of the driver arm is formed with gear teeth and defines a gear segment 62 which meshes with the worm 48 of the actuator 40. When the hand crank 41 of the actuator is turned back and forth, it acts through the bevel gears 45 and 46, the worm 48 and the gear segment 62 to turn the driver arm 60 back and forth about the pivot 61.

Pursuant to the invention, back and forth turning of the driver arm 60 effects locking and unlocking of the latch bolts 53. For this purpose, a pair of identical and vertically spaced links 63 (FIGS. 3 and 5) are pivotally connected to the free end portion of the driver arm at 64. The opposite end portions of the links 63 pivotally receive a vertical drive pin 65 connected rigidly to and projecting upwardly from a block-like slide 66 which forms part of an actuating linkage to the latches 49 and 50. The slide is located within a metal guide or track 67 of inverted U-shaped cross-section extending along the sill 28 and fastened to the sill by screws 68. A plastic guide channel 69 (FIG. 2) is located in the track 67 and supports the slide 66 for back and forth movement in the track. During such movement, the drive pin 65 travels in a straight slot 70 (FIG. 3) formed through the top of the track 67 and extending lengthwise of the sill 28.

Connected to the lower side of the slide 66 by a pair of rivets 71 (FIG. 5) is one end portion of a longitudinally stiff but laterally flexible elongated member which herein is a length of tape 72 made of metal or plastic. The tape 72 extends between the guide channel 69 along the sill 28 toward the right side jamb 30 and then curves upwardly and extends along the jamb, the guide channel also curving upwardly and extending along the jamb. The upper end portion of the drive tape 72 is connected by fasteners 73 to a block 74 which is supported for up and down sliding in the guide channel 69. A mounting bracket 75 (FIG. 9) is connected to the block by the fasteners 73 and is rigidly connected at 76 to the lower end of a rigid and vertically extending bar 77 which is guided for up and down movement by tabs 78 on the mounting plates 51 of the latches 49 and 50.

Figure 9:
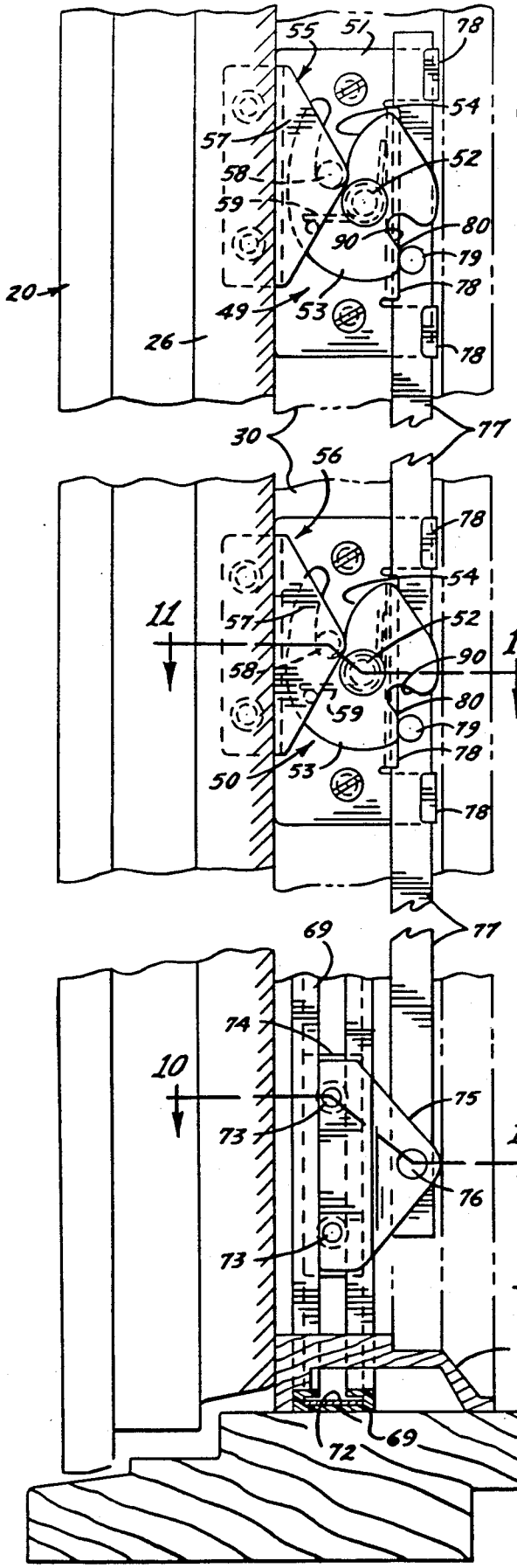
FIG. 9 is an enlarged fragmentary cross-section taken substantially along the line 9—9 of FIG. 3.
Figure 10:
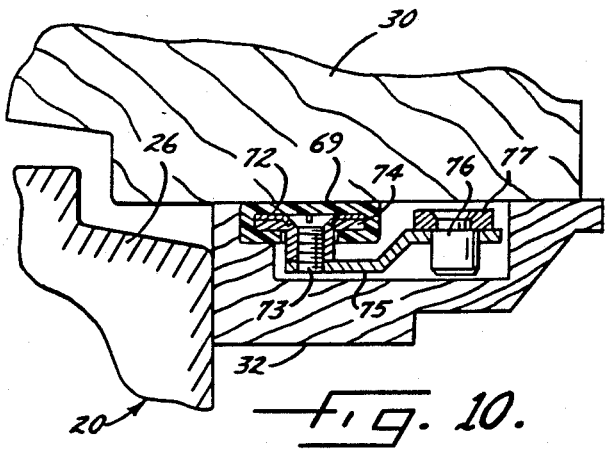
FIGS. 10 and 11 are fragmentary cross-sections taken substantially along the lines 10—10 and 11—11, respectively, of FIG. 9.

When the sash 20 is fully closed, the bar 77 is positioned as shown in FIG. 9 and, when so positioned, vertically spaced pins 79 on the bar bear against vertically extending edges 80 of the latch bolts 53 and positively hold the latch bolts against turning counterclockwise from their locked positions. When the bar is shifted upwardly from the position shown in FIG. 9, the pins 79 move upwardly off of the vertical edges 80 and effect unlocking of the latch bolts in a manner which will subsequently be described in detail. Downward return of the bar to the position shown in FIG. 9 causes the pins to turn the latch bolts clockwise to their locked positions in a manner which also will be described in more detail below.

In carrying out the invention, the same actuator arm 60 for unlocking and locking the latches 49 and 50 also acts through a linkage to effect opening and closing of the sash 20. To this end, the linkage includes an arm 81 (FIG. 7) pivotally mounted to turn about a vertical screw 82 in the cover 43 and formed with a slot 81 which receives the driver pin 65. Part of the arm 83 overlies the track 67 and its free end is pivotally connected at 84 to one end of a link 85. The other end of the link is pivotally connected at 86 to a bracket 87 secured to the bottom member 24 of the sash 20 adjacent the left side member 25 thereof. When the sash arm 81 is turned clockwise about the pivot 82, it acts through the link 85 to cause the sash 20 to move from a fully closed position shown in FIG. 3, to an intermediate position shown in FIG. 7 and then to a fully open position shown in FIG. 8. Counterclockwise turning of the arm 81 moves the sash reversely and returns the sash toward the fully closed position shown in FIG. 3.

Importantly, the slot 83 in the sash arm 81 is shaped such that, when the sash 20 is fully closed, initial clockwise turning of the driver arm 60 causes the pin 65 to shift the slide 66 to the right to effect unlocking of the latches 49 and 50 but does not produce movement of the sash arm 81 to open the sash 20. After the latches have been at least partially unlocked, continued clockwise turning of the driver arm 60 causes the pin 65 in the slot 83 to effect clockwise turning of the sash arm 81 and opening of the sash 20.

The foregoing is achieved by shaping the slot 83 in the sash arm 81 such that it includes an elongated straight portion 88 which overlies and extends parallel to the slot 70 in the track 67 when the sash 20 is fully closed and locked as shown in FIG. 3. At the right end of the straight portion 88, the slot 83 is formed with a curved portion 89 which extends generally inwardly. The curved portion 89 of the slot 83 is shaped and located so as to avoid binding interference with the pin 65 as the arm 81 turns and as the pin moves in the slot 70.

When the sash 20 is fully closed and locked, the arms 60 and 81 are positioned as shown in FIG. 3 and, in this position, the driver pin 65 is located in the straight portion 88 of the slot 83. When the hand crank 41 is rotated to turn the driver arm 60 clockwise, the links 63 pull the driver pin 65 to the right and, because the driver pin is constrained by the slot 70 in the track 67, the pin travels in a straight line and produces no turning force against the edges of the straight portion 88 of the slot 83 in the sash arm 81. The pin 65 does, however, cause the slide 66 to shift to the right. The slide acts through the longitudinally stiff tape 72, the block 74 and the bracket 75 to shift the bar 77 upwardly and cause the pins 79 to move upwardly to positions unlocking the latch bolts 53 (see FIG. 14).

Figure 7:
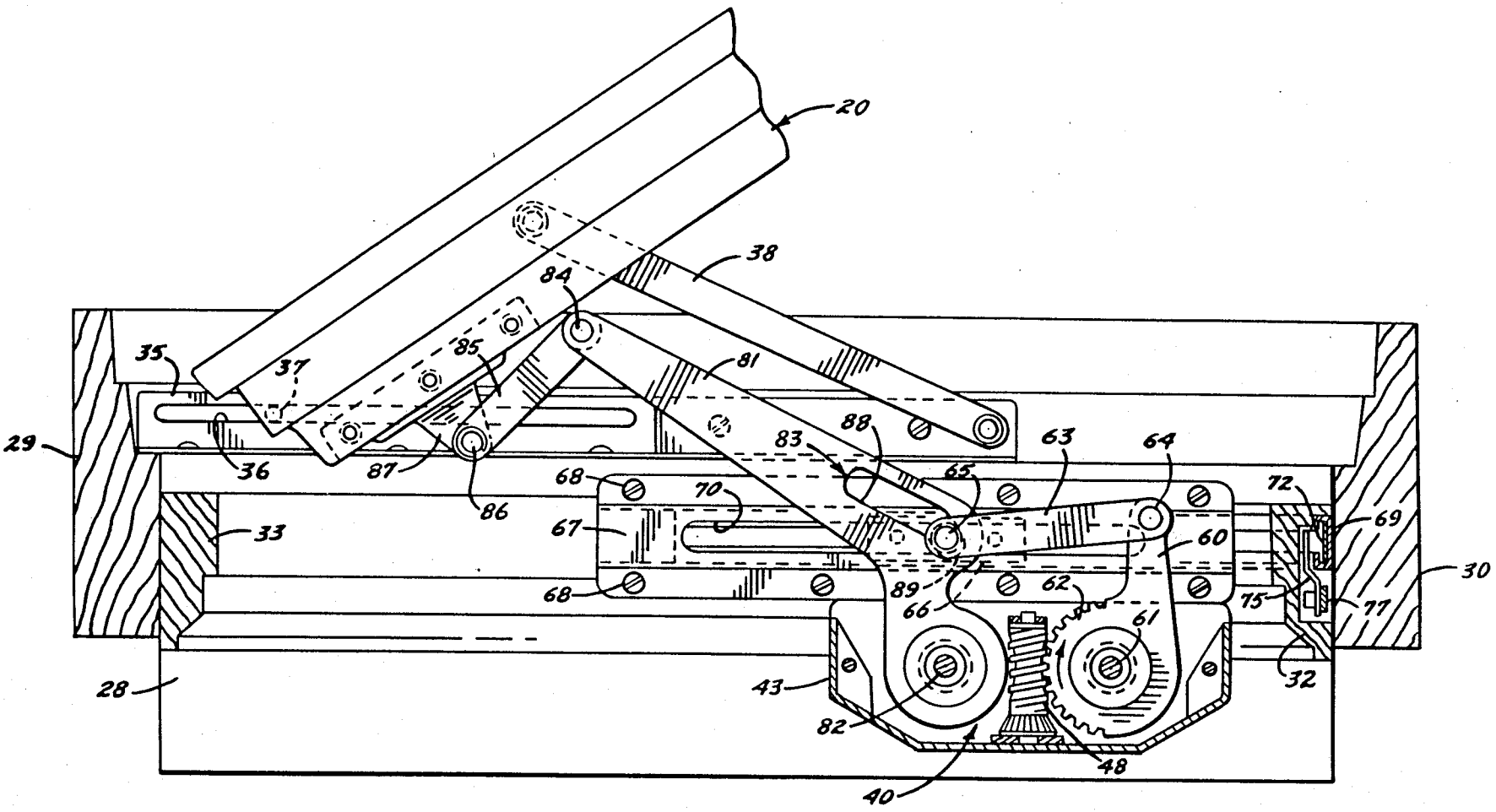
FIG. 7 is a view similar to FIG. 3 but shows the sash in a partially open position.
Figure 8:
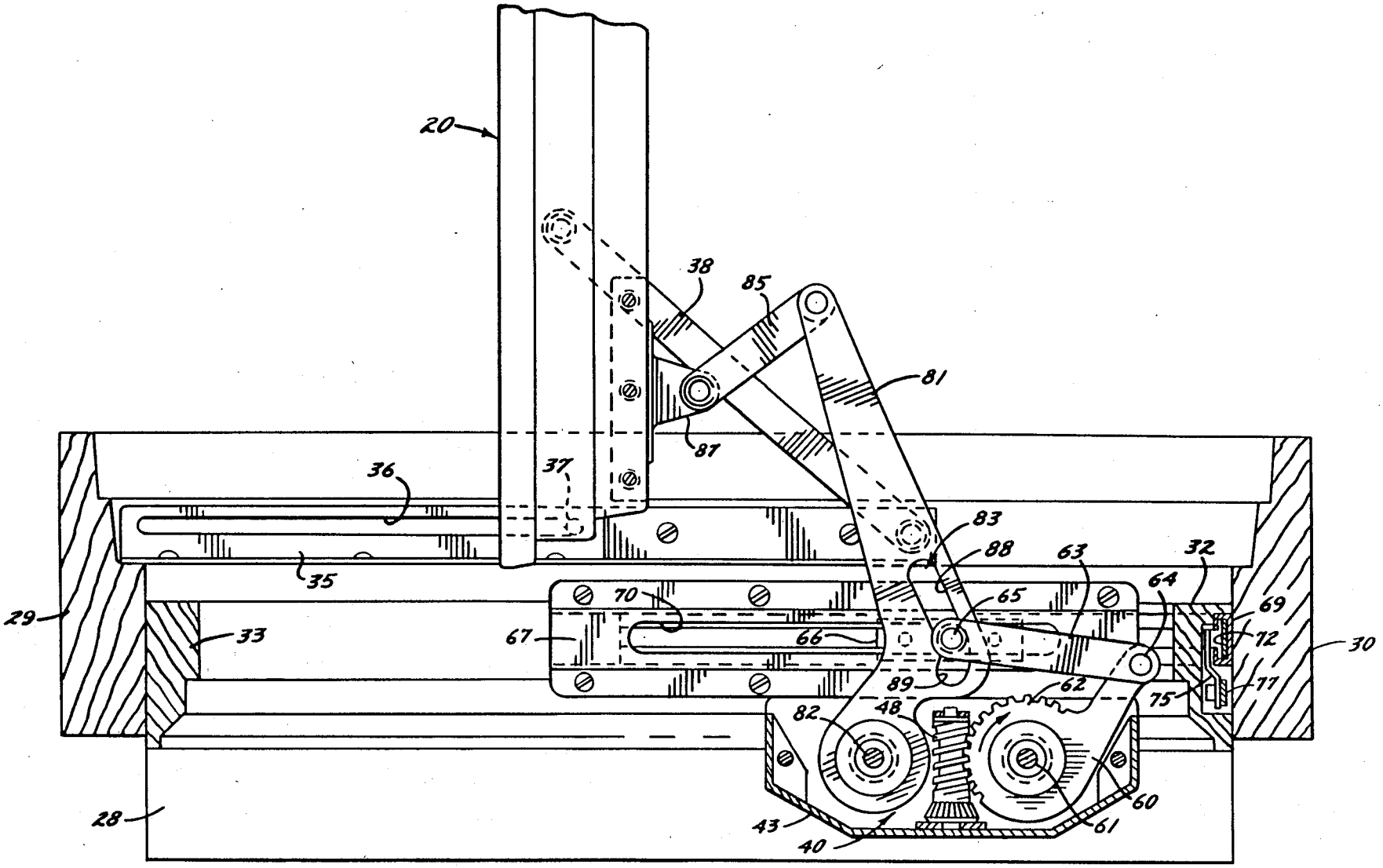
FIG. 8 also is a view similar to FIG. 3 but shows the sash in a fully open position.

With continued clockwise turning of the driver arm 60, the rightwardly moving drive pin 65 encounters the outside edge of the curved portion 89 of the slot 83 in the sash arm 81. As a result, the pin 65 starts turning the sash arm 81 clockwise and starts opening the sash 20. As the sash opens, the curved portion 89 of the slot 83 turns into embracing relation with the drive pin 65 and continues to turn into embracing relation with the pin until the sash has opened through an angle of about 45 degrees as shown in FIG. 7. Upon still further clockwise turning of the driver arm 60, the curved portion 89 of the slot 83 starts turning out of embracing relation with the drive pin 65 (see FIG. 8) but the pin continues to apply a turning moment to the edge of the slot and continues to open the sash until the sash has been opened through about 90 degrees.

When the driver arm 60 subsequently is turned counterclockwise, the driver pin 65 bears against the opposite edge of the curved portion 89 of the slot 83 and forces the sash arm 81 to turn counterclockwise to close the sash 20. During counterclockwise turning of the driver arm, the curved portion 89 of the slot 83 first moves into and then out of embracing relation with the drive pin 65 as the drive pin continues to bear against the edge of the slot. When the pin 65 starts moving to the left in the straight portion 88 of the slot 83, the sash is fully closed and the remainder of the leftward movement of the pin acts through the slide 66 and the tape 72 to pull the bar 77 downwardly and cause the pins 79 to hold the latch bolts 53 in their locked positions shown in FIG. 9.

The specific manner in which the latch bolts 53 are unlocked is illustrated in FIG. 9 and in FIGS. 12 to 15. In FIG. 9, the bar 77 is shown in the downwardmost position which the bar occupies when the sash 20 is fully closed and no further counterclockwise turning of the crank 41 is possible. As stated above, the pins 79 engage the vertical edges 80 of the latch bolts 53 when the bar is positioned as shown in FIG. 9 and positively prevent counterclockwise turning of the latch bolts. This defeats any attempt to open the sash 20 from the outside by pulling on the sash.

Figure 12:
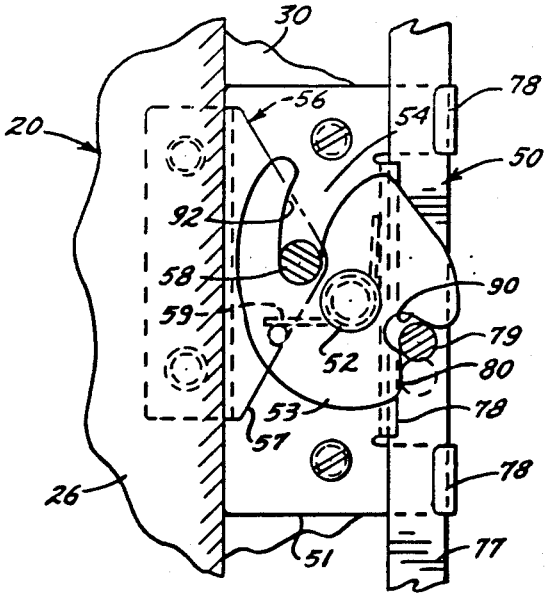
FIGS. 12 to 15 are elevational views of one of the latches illustrated in FIG. 9 and show the latch in successively moved positions.

When the drive pin 65 first starts moving to the right, each pin 59 moves upwardly from the position shown in FIG. 9 to the position shown in FIG. 12 and begins to enter a notch 90 in the inner edge of the associated latch bolt 53. When the pin 59 is positioned as shown in FIG. 12, the sash 20 has not yet started to open.

Figure 13:
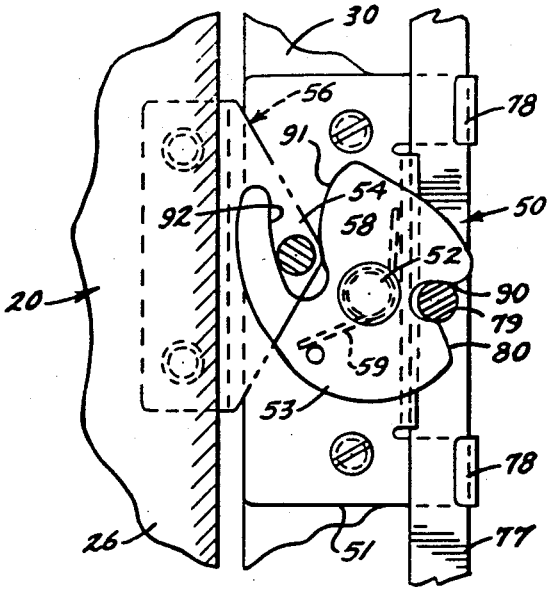
Figure 14:
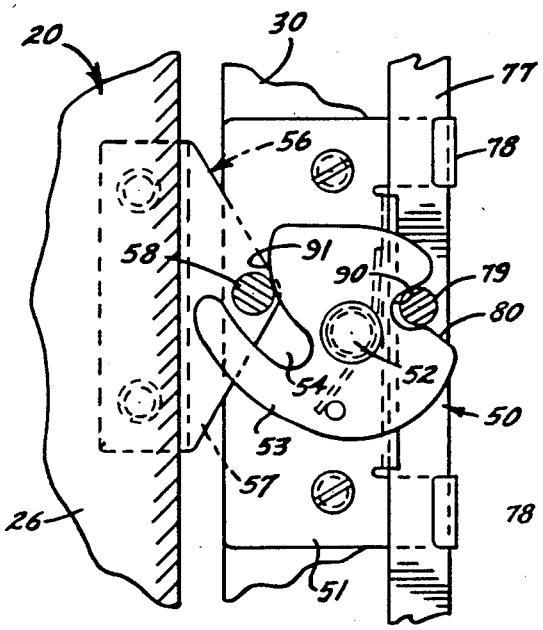

With continued upward movement, each pin 59 bears against the upper edge of the respective notch 90 and starts turning the latch bolt 53 counterclockwise toward its unlocked position. Just shortly thereafter, the sash 20 starts to open as shown in FIG. 13. As the pin 59 continues upwardly and as the latch bolt 53 continues to turn, a curved edge 91 of the throat 54 in the bolt cams against the strike pin 58 as shown in FIG. 14 and positively forces the pin outwardly to help open a sash which might be stuck by paint or ice. As the pin 59 moves upwardly out of the notch 90, the torsion spring 59 forces the latch bolt to its fully unlocked position shown in FIG. 15 to free the strike pin 58 and permit full opening of the sash 20.

When the bar 77 is shifted downwardly, each pin 59 enters the notch 90 in its respective latch bolt 53 and turns the latch bolt clockwise. As an incident thereto, the outer edge 92 of the throat 54 engages the strike pin 58 and helps draw the sash 20 inwardly to a tightly sealed position. The pin 59 then leaves the notch 90 and moves into abutting engagement with the vertical surface 80 of the locking bolt 53. While in this specific instance the latching bolt draws the sash inwardly and turns to its fully locked position at the same time the sash reaches its fully closed position, it will be appreciated that the latch bolt could reach its fully locked position shortly after the sash is fully closed.

From the foregoing, it will be apparent that the present invention brings to the art new and improved apparatus which requires only a single operation to unlock and open the sash 20 and requires only a single operation to close and lock the sash. The task of opening and closing the sash thus is simplified and, in addition, there is less chance of inadvertently leaving the sash unlocked. If desired, indicia of different colors (e.g., green and red) may be placed on each latch bolt 53 to indicate when the bolt is locked and unlocked.

Those familiar with the art will recognize that a power-operated actuator such as disclosed in Lense U.S. Pat. No. 4,553,656 may be used in place of the hand crank 41. Also, the principles of the invention may be used in conjunction with other types of windows such as awning windows.

Another embodiment of apparatus incorporating the features of the invention is shown in FIGS. 16 to 23 in which parts corresponding to those of the first embodiment are indicated by the same but primed reference numerals. The apparatus of the second embodiment is particularly characterized by its ability to hold the sash 20' very rigidly when the sash is in its open position and thereby prevent the sash from being buffeted by wind.

For all practical purposes, the latches 49' and 50' (FIG. 16) of the second embodiment are identical to those of the first embodiment. Each latch 49', 50' includes a rotatable latch bolt 53' adapted to be turned clockwise from an unlocked position shown in FIG. 16 to a locked position. Such turning is effected by means of pins 79' attached to a vertical bar 77' and operable to rotate the latch bolts in a clockwise direction when the bar is shifted downwardly. When the bar is shifted upwardly, torsion springs (not shown) turn the bolts counterclockwise from their locked positions to their unlocked positions shown in FIG. 16. Upward and downward shifting of the bar is effected by pushing and pulling a metal tape 72' whose upper end is connected to the lower end of the bar by a bracket 75'.

As before, opening and closing of the sash 20' and unlocking and locking of the latch bolts 53' are effected in response to turning of a reversible rotary actuator or crank 41'. The crank is connected rigidly to the inner end portion of a spindle 42' (FIG. 18) which is rotatably journaled in an actuator cover 43' fastened to the sill 28' A bevel gear 45' on the outer end of the spindle 42' meshes with a right-angle bevel gear 100.

In carrying out the invention, the bevel gear 100 is attached to one end of a lead screw 101 which is formed with a helical thread 102 of substantial width. The right end portion of the lead screw is journaled for rotation by the actuator cover 43'. Telescoped over the lead screw are two nuts 104 and 105 and an unthreaded sleeve 106. The nuts 104 and 105 are formed with threads 107 and 108, respectively, (FIG. 22) adapted to mate with the thread 102 of the screw 101. The nut 105 is located between the nut 104 and the sleeve 106.

Unlocking of the latch bolts 53' is effected during initial movement of the nut 105 to the right along the screw 101 while locking of the latch bolts is effected during final movement of the nut 105 to the left along the screw. For this purpose, the nut 105 includes an outwardly projecting lower flange 109 (FIG. 20) which is connected to the free end of the tape 72' by a vertical rivet 110. As the nut 105 initially travels to the right, it pushes on the tape 72' to cause the bar 77' to shift upwardly and permit unlocking of the latch bolts 53' under the influence of the torsion springs. As an incident to final travel of the nut 105 to the left, the nut 105 pulls the tape 72' and the bar 77' sufficiently far to cause the pins 79' to turn the latch bolts 53' to their locked positions. During movement of the nut 105, the rivet 110 travels in an elongated slot 111 (FIG. 23) formed in a fixed casing 112 which is supported on the sill 28' and which extends partially around the screw 101, the nuts 104 and 105 and the sleeve 106. A shroud 113 (FIGS. 19 and 20) encloses the inner and upper sides of the casing 112 and defines a molding along the sill 28'.

Importantly, the nut 104 and the sleeve 106 are connected to one another and, when moved to the right or the left, are operable to open or close the sash 20'. In order to connect the nut 104 and the sleeve 106, a generally U-shaped yoke 115 (FIG. 23) has one leg rigidly connected to the nut 104 and a second leg connected rigidly to the sleeve 106. The nut 105 is disposed within the space between the two legs of the yoke. An elongated arm 116 (FIG. 17) extends between and is connected rigidly to the two legs of the yoke 115 and projects beyond the right end of the yoke. One end portion of a sash link 117 is connected pivotally to the right end portion of the arm 116 at 118. The other end portion of the sash link is pivotally connected at 119 to a bracket 87' secured to the bottom of the sash 20'When the yoke 115 is advanced to the right or the left, it acts through the arm 116 and the link 117 to open or close the sash 20'.

Figure 17:
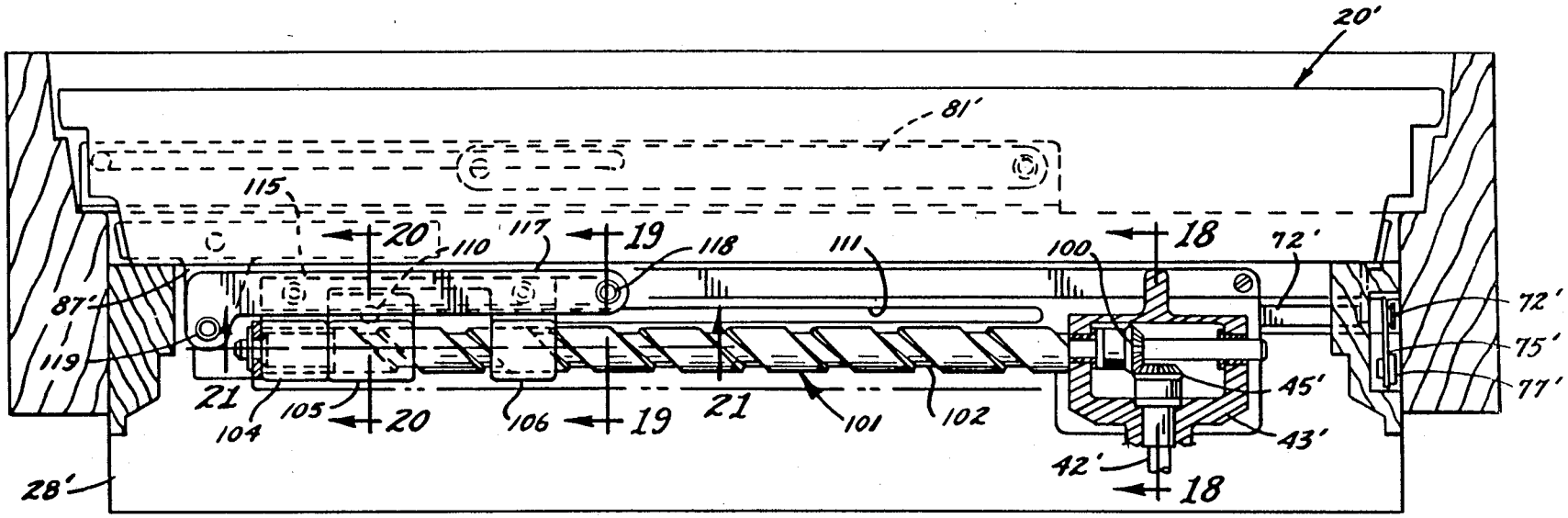
FIG. 17 is a cross-section taken substantially along the line 17—17 of FIG., 16, the sash being shown closed and locked.
Figure 21:
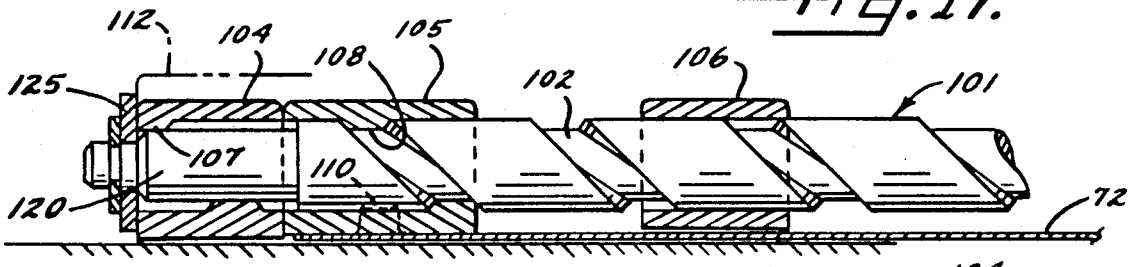
FIG. 21 is an enlarged fragmentary cross-section taken along the line 21—21 of FIG. 17 and shows the parts of the as positioned when the sash is closed and locked.

FIGS. 17 and 21 show the position of the nuts 104 and 105 and the sleeve 106 when the sash 20' is fully closed and locked. When the parts are so positioned, the nut 104 is at the extreme left end of the screw 101 while the nut 105 is located immediately adjacent the nut 104 and is spaced axially from the sleeve 106. As shown in FIG. 21, the extreme left end portion 120 of the screw 101 is unthreaded and is received in the nut 104 when the sash 20' is closed and locked. The nut 105 receives the threaded portion 102 of the screw 101 but such portion does not extend into the nut 104 when the parts are located in the position shown in FIG. 21. A bracket 125 at the left end of the screw prevents the nut 104 from sliding to the left off of the unthreaded portion 120.

Figure 18:
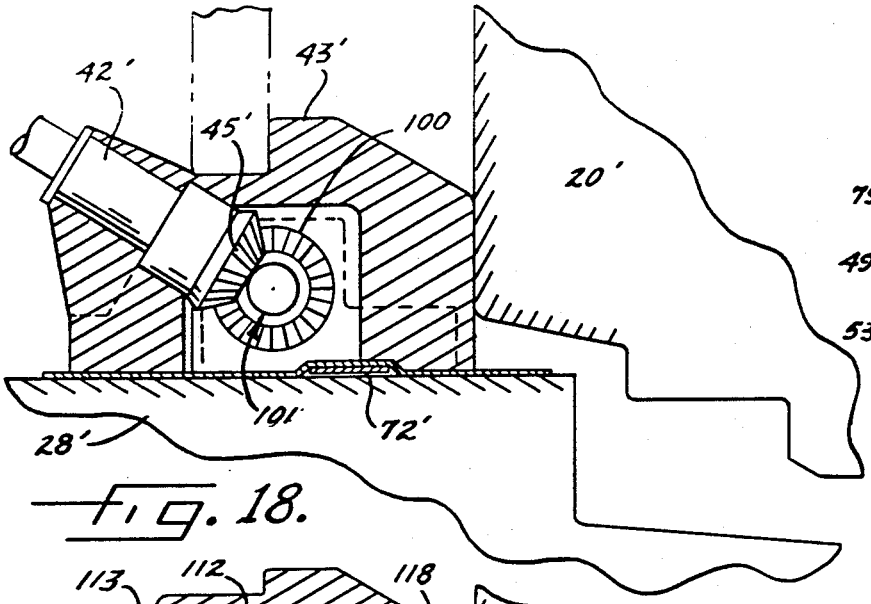
FIGS. 18, 19 and 20 are enlarged fragmentary cross-sections taken substantially along the lines 18—18, 19—19 and 20—20, respectively, of FIG. 17.
Figure 19:
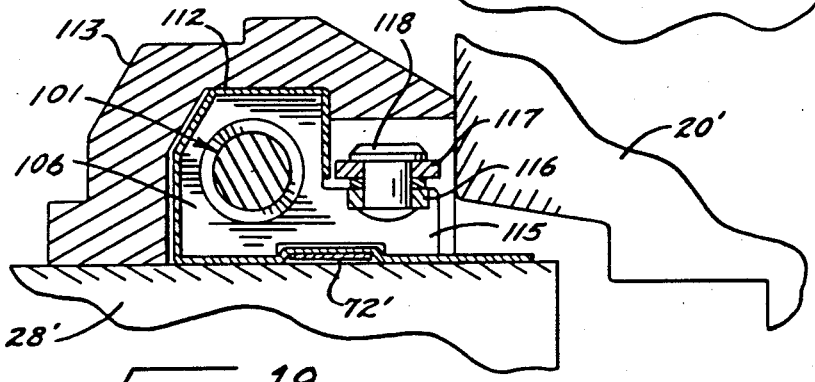
Figure 20:
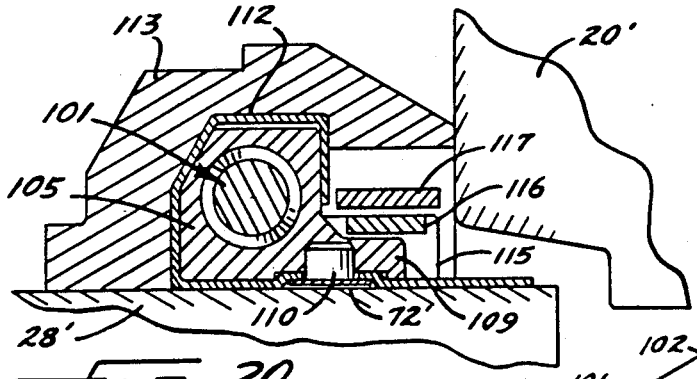
Figure 16:
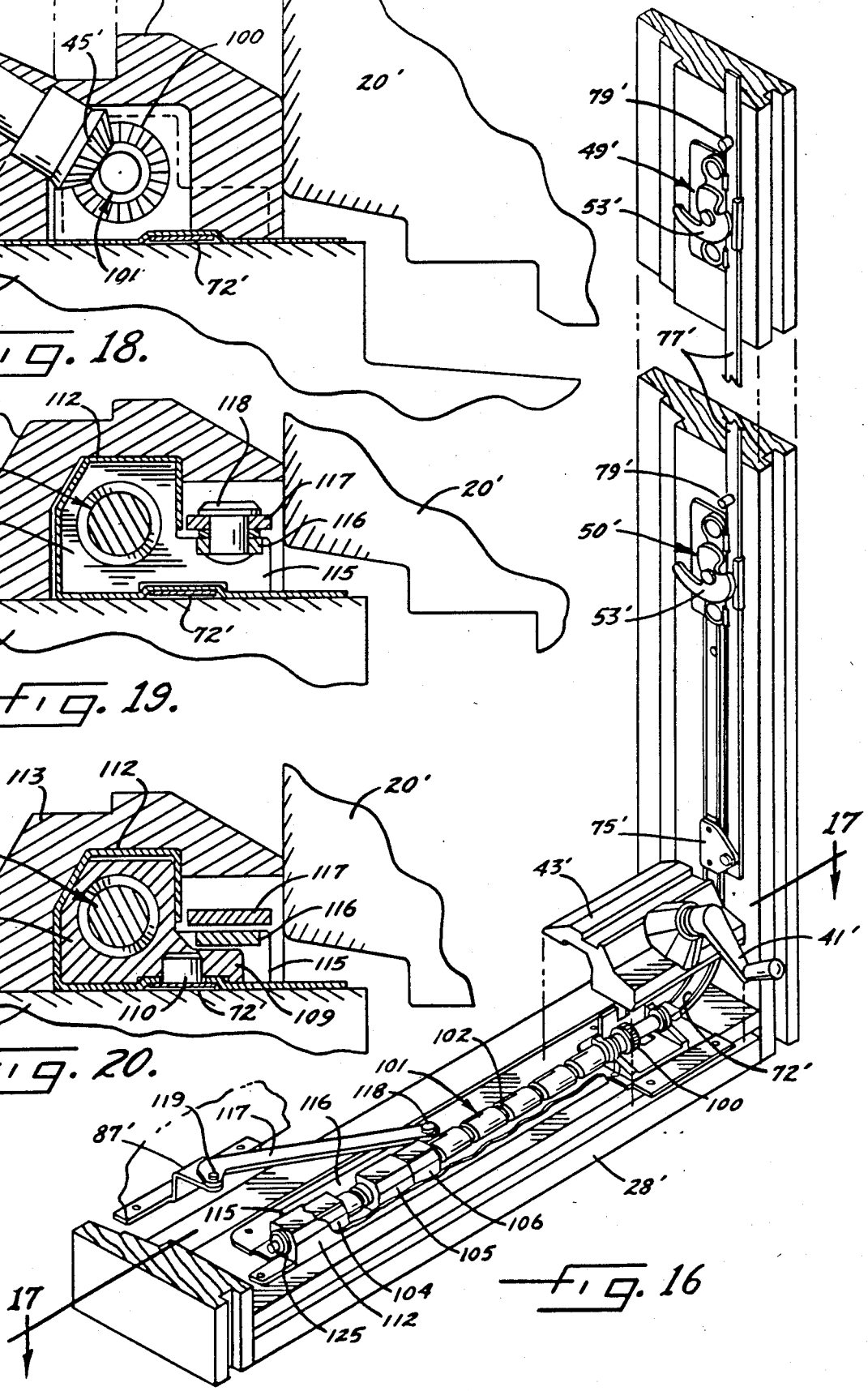
FIG. 16 is a perspective view of another embodiment of apparatus incorporating the features of the invention, the view showing the sash closed but unlocked.

As before, unlocking and opening of the sash 20' are effected by turning the crank 41' clockwise, the crank acting through the gears 45' and 100 to rotate the screw 101 clockwise (FIG. 18). When the sash is closed and locked, initial clockwise rotation of the screw 101 causes the nut 105 to move from left to right along the screw and to travel from the position shown in FIG. 21 to the position shown in FIG. 22. During such travel, the nut 105 acts through the rivet 110 to push on the tape 72' and unlock the latch bolts 53'. The nut 104, however, remains stationary during initial clockwise rotation of the screw 101 since the unthreaded portion 120 of the screw is received in the nut 104 and is not capable of advancing that nut.

Figure 22:
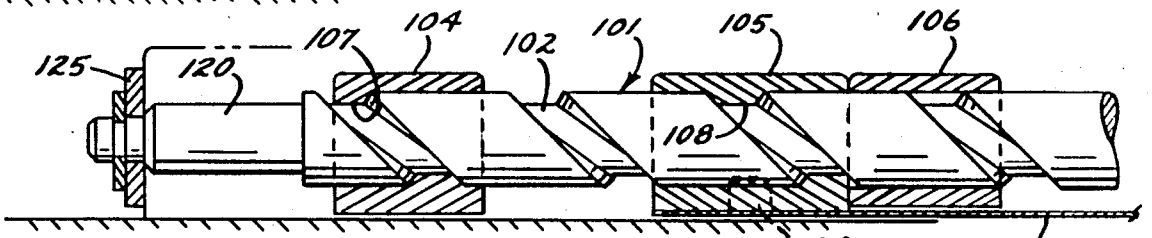
FIG. 22 is a view similar to FIG. 21 but shows the parts as positioned when the sash is unlocked and is just starting to open.
Figure 23:
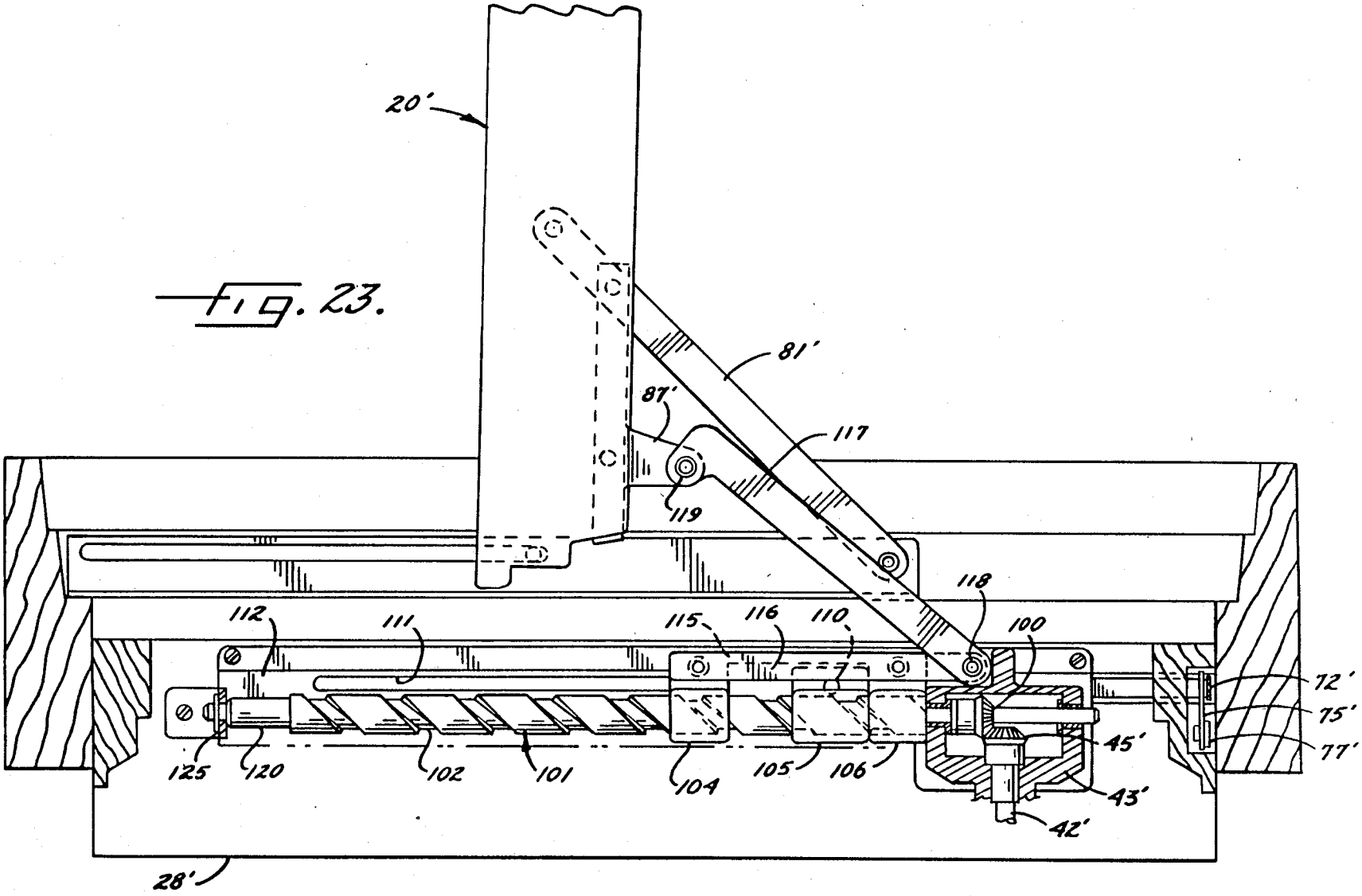
FIG. 23 is a view similar to FIG. 17 but shows the sash fully open.

When the nut 105 reaches the position shown in FIG. 22, the latch bolts 53' are fully unlocked. Upon continued clockwise rotation of the screw 101, the nut 105 engages the sleeve 106 and forces the sleeve to move to the right along the screw. As an incident thereto, the sleeve shifts the yoke 115 to the right and causes the yoke to pull the nut 104 onto the threaded portion 102 of the screw. As the screw continues to rotate, the nuts 104 and 105 force the yoke 115 to the right and act through the yoke, the sash arm 116 and the sash link 117 to swing the sash 20' to an open position as shown in FIG. 23.

When the crank 41' is turned counterclockwise, the screw 101 also is rotated counterclockwise and drives the nuts 104 and 105 to the left. As a result, the nut 104 acts to close the sash 20' while the nut 105 acts through the tape 72' to pull the bar 77' downwardly. When the sash approaches its fully closed position, the nut 104 runs off of the threaded portion 102 of the screw 101 and returns to the unthreaded portion 120. Thus, further counterclockwise rotation of the screw produces no further closing of the sash by way of the nut 104. Such rotation does, however, continue to advance the nut 105 to the left to enable that nut to pull the bar 77' downwardly sufficiently far to cause the pins 79' to lock the latch bolts 53' As an incident thereto, the bolts exert a draw-in force on the sash 20' so as to seal the sash in its closed position.

By virtue of the coaction between the screw 101 and the nut 104, the sash 20' is held rigidly in all open positions of the sash. Although the screw and the nut form a high efficiency transmission and enable the sash to be opened and closed easily when the crank 41' is turned, it is virtually impossible for the nut to turn the screw when an axial force is imposed on the nut. As a result, the sash is held very rigidly and does not buffet under the force of high winds.

It should also be noted that the apparatus of the second embodiment requires significantly fewer components beneath the cover 43' than is the case with the apparatus of the first embodiment. As a result, the cover 43' is trimmer and more compact than the cover 43.

I claim:

1. Apparatus for moving a swingable window sash between open and closed positions relative to a fixed window frame and for releasably locking the sash in its closed position, said apparatus comprising a strike mountable on said sash, a latch mountable on said frame to move between locked and unlocked positions, said latch being operable when in said locked position to engage said strike and hold said sash in said closed position and being operable when in said unlocked position to release said strike and free said sash for movement away from said closed position, a reversible rotary actuator mountable on said frame, first and second linkages connected to said sash and said latch, respectively, said first linkage being responsive to said actuator to move said sash away from said closed position when said actuator is rotated in one direction and to move said sash toward said closed position when said actuator is rotated in the opposite direction, and said second linkage being responsive to said actuator to move said latch toward said unlocked position just prior to initial movement of said sash away from its fully closed position and to move said latch toward its locked position at about the same time said sash returns to its fully closed position, said second linkage including an element movable back and forth along the bottom of said frame, second linkage further including an elongated member connected to said element, said elongated member being laterally flexible and extending along the bottom of said frame and upwardly along one side of said frame, said elongated member being longitudinally stiff and being capable when pushed by said element to move said latch between said latched and unlatched positions.

2. Apparatus as defined in claim 1 in which said element comprises a slide.

3. Apparatus as defined in claim 1 in which said element comprises a nut, and a lead screw telescoped into said nut and operable when rotated to move said nut linearly along the bottom of said frame.

4. Apparatus for moving a swingable window sash between open and closed positions relative to a fixed window frame and for releasably locking the sash in its closed position, said apparatus comprising a strike mountable on said sash, a latch mountable on said frame to move between locked and unlocked positions, said latch being operable when in said locked position to engage said strike and hold said sash in said closed position and being operable when in said unlocked position to release said strike and free said sash for movement away from said closed position, a reversible rotary actuator mountable on said frame, first and second linkages connected to said sash and said latch, respectively, said first linkage being responsive to said actuator to move said sash away from said closed position when said actuator is rotated in one direction and to move said sash toward said closed position when said actuator is rotated in the opposite direction, said first linkage comprising a pivotally mounted arm having a free end portion operably connected to said sash, said second linkage being responsive to said actuator to move said latch toward said unlocked position just prior to initial movement of said sash away from its fully closed position and to move said latch toward its locked position at about the same time said sash returns to its fully closed position, said second linkage including a slide which is operably connected to said latch, and means connecting said actuator to said arm and said slide and operable first to move said slide without moving said arm and operable then to pivot said arm as said actuator is rotated to move said sash away from said fully closed position.

5. Apparatus as defined in claim 4 further comprising a guide supporting said slide for back and forth movement along a straight path, a slot in said arm, said means comprising a pin connected to said slide and received within said slot to travel back and forth therein.

6. Apparatus as defined in claim 5 in which said slot is formed with a straight portion extending parallel to the direction of movement of said slide and is formed with a curved portion at one end of said straight portion, said pin being operable when traveling along the straight portion of said slot to move said latch between said locked and unlocked positions and being operable when traveling along the curved portion of said slot to move said sash between said open and closed positions.

7. Apparatus as defined in claim 5 in which said actuator includes a second pivotally mounted arm having a free end portion which carries said pin.

8. Apparatus as defined in claim 7 in which said arms are mounted to pivot about parallel axes.

9. Apparatus as defined in claim 4 in which said second linkage further includes an elongated member connected to said slide, said elongated member being laterally flexible and extending along the bottom of said frame and upwardly along one side of said frame, said elongated member being longitudinally stiff and being capable when pushed by said slide to move said latch between said latched and unlatched positions.

10. Apparatus as defined in claim 4 in which said latch is mounted to pivot between said locked and unlocked positions and is formed with a throat which receives said strike when said latch is in said locked position, one side of said throat being shaped to cam against said strike and push said sash away from said fully closed position as said latch pivots toward said unlocked position.

11. Apparatus as defined in claim 10 in which the other side of said throat is shaped to engage said strike and pull said sash toward said fully closed position as said latch pivots toward said locked position.

12. Apparatus for causing a window to swing about a predetermined axis between open and closed positions relative to a fixed window frame and for releasably locking the sash in its closed position, said apparatus comprising a strike mountable on said sash, a latch mountable on said frame to move between locked and unlocked positions, said latch being operable when in said locked position to engage said strike and hold said sash in said closed position and being operable when in said unlocked position to release said strike and free said sash for movement away from said closed position, a first arm mounted to turn about an axis paralleling the axis of swinging of said sash, means connecting said first arm to said sash and operable to move said sash between said open and closed positions in response to back and forth turning of said first arm, a slide mounted to move back and forth along a straight path, means connecting said slide to said latch and operable to move said latch between said locked and unlocked positions in response to back and forth movement of said slide, a reversible rotary actuator having a second arm mounted to turn back and forth about an axis paralleling that of said first arm, and means coupling said second arm to said first arm and said slide, said coupling means acting on said slide to move said latch toward said unlocked position and then acting on said first arm to move said sash away from said fully closed position in response to initial turning of said second arm in one direction, and said coupling means acting on said first arm to move said sash toward said fully closed position in response to turning of said second arm in the opposite direction and then acting on said slide to move said latch to said locked position at about the same time said sash reaches said fully closed position.

13. Apparatus as defined in claim 12 in which said coupling means comprise a link having one end portion pivotally attached to the free end portion of said second arm, a pin pivotally attached to the other end portion of said link and connected to said slide, and a slot formed in said first arm and slidably receiving said pin.

14. Apparatus as defined in claim 13 in which said slot is formed with a straight portion extending parallel to the direction of movement of said slide and is formed with a curved portion at one end of said straight portion, said pin being operable when traveling along the straight portion of said slot to move said latch between said locked and unlocked positions and being operable when traveling along the curved portion of said slot to move said sash between said open and closed positions.

15. Apparatus for moving a swingable window sash toward and away from a closed position relative to a fixed window frame and for releasably locking the sash in its closed position, said apparatus comprising a strike mountable on said sash, a latch mountable on said frame to move between locked and unlocked positions, said latch being operable when in said locked position to engage said strike and hold said sash in said closed position and being operable when in said unlocked position to release said strike and free said sash for movement away from said closed position, a reversible rotary actuator mounted on said frame, mechanism responsive to rotation of said actuator in a first direction to first move said latch from said locked position to said unlocked position and to then move said sash away from said closed position, said mechanism being responsive to rotation of said actuator in a second direction to first move said sash toward said closed position and then to move said latch toward said locked position at about the same time said sash reaches said closed position, said mechanism comprising a screw coupled to said actuator for rotation by the latter, first and second nuts movable back and forth along said screw, a first linkage connected between said sash and said first nut and operable to move said sash away from said closed position when said first nut is moved in one direction along said screw and to move said sash toward said closed position when said first nut is moved in the opposite direction along said screw, a second linkage connected between said latch and said second nut, said second linkage being operable to move said latch toward said unlocked position when said second nut is moved in said one direction along said screw and to move said latch toward said locked position when said second nut is moved in said opposite direction along said screw, and means operable when said sash is in said closed position and said latch is in said locked position to delay movement of said first nut in said one direction along said screw until said screw has been rotated sufficiently far to advance said second nut along said screw a predetermined distance in said one direction, and said means also being operable when said sash is in said closed position and said latch is in said unlocked position to prevent movement of said first nut along said screw in said opposite direction during rotation of the screw while permitting said second nut to move along said screw in said opposite direction.

16. Apparatus as defined in claim 15 in which said screw includes a threaded portion and an unthreaded portion, said unthreaded portion constituting said means, said first and second nuts being telescoped over said unthreaded portion and said threaded portion, respectively, when said sash is in said closed position and said latch is in said locked position.

17. Apparatus as defined in claim 16 further including means engageable with said second nut and operable to move the first nut from the unthreaded portion of said screw to the threaded portion thereof when said sash is in said closed position and as an incident to movement of said second nut through said predetermined distance in said one direction along said screw.

18. Apparatus as defined in claim 17 in which said engageable means comprise a sleeve telescoped over said screw and located to be engaged by said second nut when the latter is moved in said one direction along said screw after said latch has been moved to said unlocked position, and means connecting said sleeve and said first nut for movement in unison along said screw.

19. Apparatus as defined in claim 18 in which said second nut is located between said first nut and said sleeve.

20. Apparatus for causing a window to swing about a predetermined axis between open and closed positions relative to a fixed window frame and for releasably locking the sash in its closed position, said apparatus comprising a strike mountable on said sash, a latch mountable on said frame to move between locked and unlocked positions, said latch being operable when in said locked position to engage said strike and hold said sash in said closed position and being operable when in said unlocked position to release said strike and free said sash for movement away from said closed position, a rotatable screw, a reversible rotary actuator for selectively rotating said screw in either a first direction or in a second direction, a sleeve and first and second nuts telescoped over said screw, a first linkage connecting said first nut to said sash, said first linkage being operable to open said sash when said first nut is moved in one direction along said screw and being operable to close said sash when said first nut is moved in the opposite direction along said screw, a second linkage connecting said second nut to said screw, said second linkage being operable to move said latch from said locked position to said unlocked position when said second nut is moved in said one direction along said screw and being operable to move said latch from said unlocked position to said locked position when said second nut is moved in said second direction along said screw, said screw having threaded and unthreaded portions, said threaded portion being received within said sleeve and said second nut, said unthreaded portion being received in said first nut when said sash is in said closed position, said second nut being located between said first nut and said sleeve and being spaced along said screw from said sleeve when said latch is in said locked position, said second nut engaging said sleeve and moving said sleeve in said one direction along said screw after said second nut has advanced through a predetermined distance in said one direction, and means connecting said sleeve to said first nut and operable to move said first nut onto the threaded portion of said screw during advance of said sleeve in said one direction.

* * * * *